US006241624B1

(12) United States Patent
Zabytko et al.

(10) Patent No.: US 6,241,624 B1
(45) Date of Patent: Jun. 5, 2001

(54) MALLET STYLE GOLF CLUB

(76) Inventors: Luanne Byers Zabytko, P.O. Box 7997, Wilmington, DE (US) 19803-0997; Nyra W. Whelchel, 4701 Harness La., Murrells Inlet, SC (US) 29576; Francis E. (Buddy) Wilkes, 8019 Sumter Hwy., Columbia, SC (US) 29209

( * ) Notice: Subject to any disclaimer, the term of this patent is extended or adjusted under 35 U.S.C. 154(b) by 0 days.

(21) Appl. No.: 09/236,699

(22) Filed: Jan. 25, 1999

(51) Int. Cl.[7] ..... A63B 53/04
(52) U.S. Cl. ..... 473/340; 473/252; 473/324
(58) Field of Search ..... 473/242, 251, 473/252, 324, 329, 340, 342

(56) References Cited

U.S. PATENT DOCUMENTS

| | | | | |
|---|---|---|---|---|
| 1,666,174 | | 4/1928 | Holland . | |
| 2,491,383 | | 12/1949 | Liolich . | |
| 2,957,696 | * | 10/1960 | Warpotas . | |
| 3,143,349 | | 8/1964 | MacIntyre . | |
| 3,836,153 | | 9/1974 | Dance . | |
| 3,881,733 | | 5/1975 | Csernits . | |
| 3,955,819 | | 5/1976 | Yokich . | |
| 4,325,550 | * | 4/1982 | Thompson . | |
| 4,568,088 | | 2/1986 | Kurahashi . | |
| 4,832,344 | | 5/1989 | Werner . | |
| 5,083,778 | | 1/1992 | Douglass . | |
| 5,324,031 | * | 6/1994 | Green | 473/340 X |
| 5,354,054 | * | 10/1994 | Akatsuka et al. | 473/324 X |
| 5,383,664 | * | 1/1995 | Epperson | 473/340 |
| 5,643,100 | * | 7/1997 | Zabytko et al. | 473/340 X |
| 5,690,556 | * | 11/1997 | Condon | 473/252 |
| 5,720,668 | * | 2/1998 | Brett | 473/242 X |

OTHER PUBLICATIONS

The Dupont Merchandise Collection cover & p. 16.

* cited by examiner

*Primary Examiner*—John A. Ricci

(57) ABSTRACT

A mallet style golf club with a novel head design consists of solid materials laminated or inlaid horizontally to yield a single surface alignment aid on the surface that strikes the golf ball (the front face/face). Optional alignment markings on the top surface of the club, centered over the point on the face where there is minimal torque when the head strikes the golf ball ("sweet spot"), combine with the single surface alignment aid on the face to form a single surface two-dimensional alignment system. An inlaid or laminated line on the circumference of the mallet joins the inlaid or laminated horizontal line on the front face to form a visually perceived 360 degree, three dimensional alignment aid. The resilient nature of the solid materials used for the preferred embodiment (putter) imparts a softer "feel" to the golfer, reduces skid of the ball after the ball is struck, and produces a light-weight club, allowing the golfer to use a fuller complete stroke for each putt, thereby improving precision and accuracy from putt to putt. The sole of the club head is curved upward from the center of the head toward the heel and toe to decrease friction and resistance from contact with the grass or ground as the putter head swings away from and through the ball during the putting stroke. Lead or alloy weights may be added through a cavity to optimize the weight and balance. Milling the face improves the contact point between the face and the golf ball.

16 Claims, 6 Drawing Sheets

MALLET STYLE GOLF CLUB

BACKGROUND OF THE INVENTION

This invention relates to golf clubs and more particularly to a club that has any head shape known as a mallet style(putters, drivers, fairway woods, chippers) that uses any material for the club head which allows novel design improvements thereby enhancing the precision and accuracy of the golfer's alignment and set-up to a shot. In the case of a putter or chipper, the material may allow for a "softer feel" to the putt or chip, which further enhances the golfer's performance.

When putting, chipping, or hitting a long shot with woods, the golfer must properly align the club so that the point of impact of the club face against the golf ball is directed toward the target. Numerous club designs have lines, grooves, or other markings on top of the club to optimize this alignment. Three additional components of alignment that are also important are the position of the hands over the ball, the position of the club face perpendicular to the line of the target (also known as "squareness" of the club face), and the proper positioning of the eyes (which directly impacts correct head and body position) over the set-up to the shot.

Existing putters do not combine club face and club top markings for alignment without violating the single solid surface integrity of the club face. That is, putters with engraved grooves, painted lines and inlays on the putter face do not have a single solid surface face. These alterations to the face affect the "feel" and responsiveness of the shot. This is also true for chippers and woods; however, the lines engraved on the faces of these clubs serves a purpose to impart spin on the ball.

SUMMARY OF THE INVENTION

An object of the present invention is to provide a putter. chipper, wood, or a mallet design club which allows the player to align the club face, the hand position, the eye position, and the "sweet spot" to the ball in order to increase the precision and accuracy of the golf shot.

Another object is to provide optimal swing weight for the club. An optimal weight allows the golfer to fully stroke through the ball, obtaining a truer shot and line toward the hole or the green without compromising club head speed.

Yet another object is to provide a club that does not drag along the ground during the back swing and stroke. Dragging the club along the ground can take the club off-line, affect the take-away, and decelerate the stroke through the ball. Minimizing the contact of the sole of the club head with the ground will allow for a complete, clean stroke and improve the chances for a good shot.

A further objective is to provide a putter or chipper head that has a "softer feel" than a metal club head when striking the ball. Reducing the ball rebound off the face will minimize skidding of the ball and allow it to stay true to the line of the shot. A "softer feel" also instills more confidence to the golfer, which decreases the propensity for the player to "quit on the stroke."

In accordance with these objectives, the present invention provides a club head that includes a visible horizontal line in the center of the front face. For a putter and chipper, the face may consist of a single solid surface. For a wood or other mallet shaped club, the face may consist of two or more solid surfaces of similar composition (e.g., metal, composite material, wood) that create a visible horizontal line in the center of the front face. The horizontal line is visible only when the club head and the golfer's hands are positioned correctly to the ball. This visible horizontal line in the center of the front face forms a single-surface alignment aid. In addition, an optional inlaid line on the top of the club may be inserted to form a 90° angle to the visible horizontal line when the club head and the golfer's hands are in the correct position for the golf shot. The combination of these markings from two different surfaces or planes of the club head produces a club with a two dimensional alignment aid.

Further in accordance with the objectives of this invention is the presence of a visible inlaid line on the circumference of the mallet that connects with the visible horizontal line on the front face. The combination of the horizontal lines on the front face and on the circumference of the mallet creates a 360 degree 3-dimensional alignment aid that is visible only when the club head and the golfer's hands and eyes (head/body position) are positioned correctly to address the ball.

The present invention is designed to optionally allow addition of weight to a cavity in the head, through a cavity that is drilled/carved into any surface that does not strike the golf ball. In the preferred embodiment (putter), the cavity is drilled and located in the middle of the sole on the club head. Adjustment of the swing weight allows the club to have enough mass to generate a good impact to the ball without making the putter too heavy.

In this invention, the sole of the club head may optionally be curved to minimize the point of contact between the sole of the club head and the ground.

In one embodiment, the putter head is made from CORIAN® (methyl methacrylate monomer and aluminum trihydrate) by DuPont. This material has a "softer feel" to the golfer than metal when he or she strikes the ball but is of sufficient hardness to impart roll to the ball.

Briefly, the present invention relates to a golf putter or any mallet shaped golf club which has a single surface striking face which generally is vertically oriented. The single striking surface is comprised of solid materials assembled to form a visible horizontal straight line in the center of the face. The loft imparted to the face of the club provides the golfer with a visual perception of a thin solid line when the hands of the golfer are holding the club and correctly positioning the club over the ball at address. Markings on the top of the club head may optionally be positioned over the "sweet spot" to form a visually perceived 90° angle to the visually perceived horizontal line on the face of the club head when the hands of the golfer are holding the club and correctly positioning it over the ball and toward the target at address. Inlaid markings that continue around the circumference of the mallet club head and join the markings on the front face create a visually perceived, uniform 360 degree outline when the hands are properly placing the club and the eyes are correctly positioned over the ball and toward the target at address. The combination of these markings from three different surfaces or planes of the club head produces a club with a visually perceived three dimensional alignment aid. The club also has a cavity for insertion of weight, such as lead or a similar alloy, of greater density than the material used for the club (putter) head, to allow optimization of the swing weight, if needed. Insertion of the weight behind the "sweet spot" reduces the face deflection of a putter, wood, or chipper upon impact by enlarging the size of the "sweet spot." The club head may be shaped on the bottom or sole in an arcuate fashion to reduce the chance of the club head dragging along or striking the ground during the take-away. This configuration of the sole provides the golfer with an improved chance of properly striking the ball resulting in a reduced chance of the club head being deflected off-line. The use of material for the preferred embodiment of the putter head that is softer than conventional materials used for putter heads produces a putter with a "softer feel." A "softer feel" enables the golfer to take a full, complete putting stroke, resulting in an accurate on-line shot with minimal skidding and acceptable ball speed on the putting surface.

The advantage of this invention will become apparent from the description which follows and accompanies the drawings.

DETAILED DESCRIPTION

Figure 1:
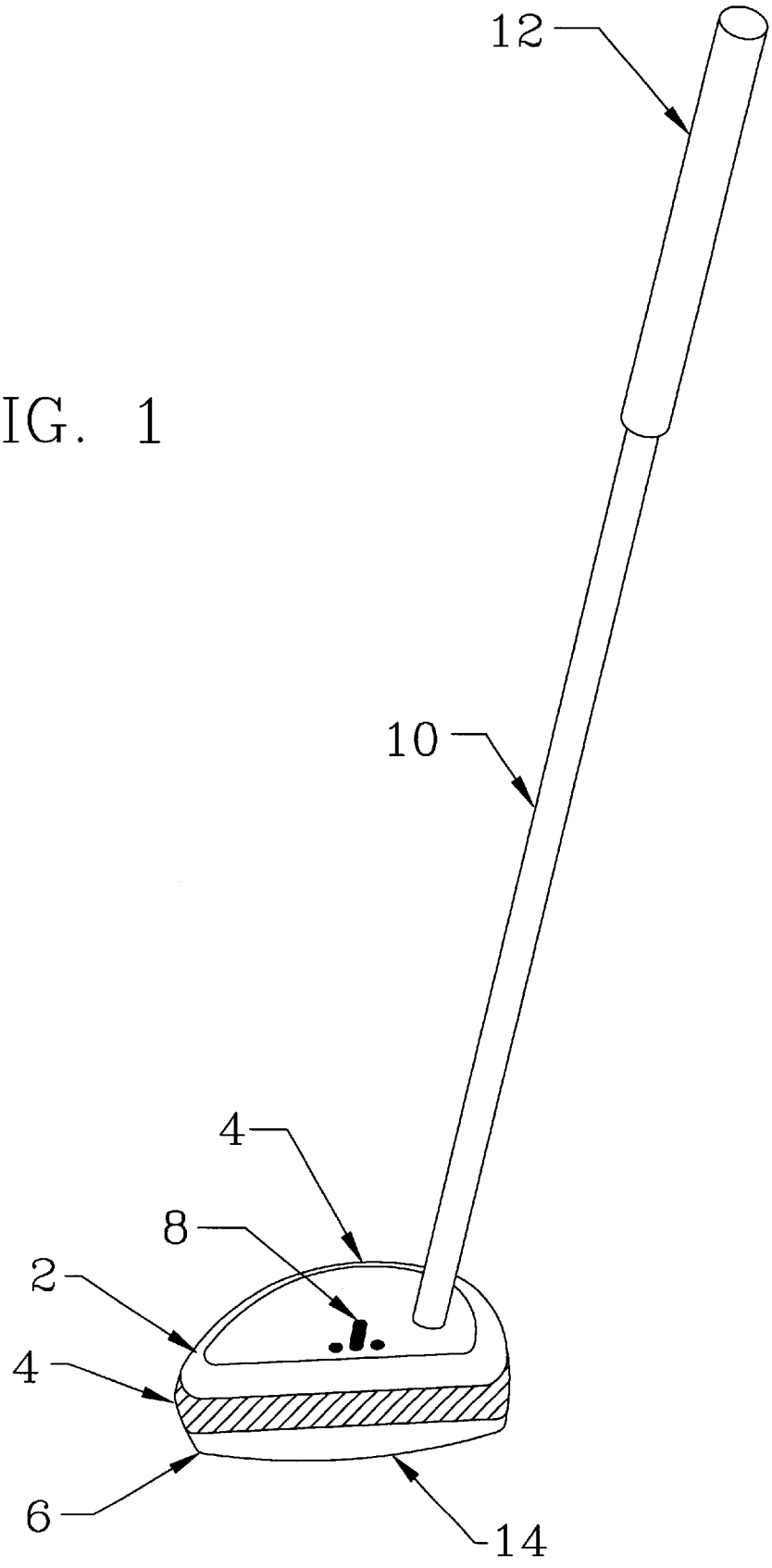
FIG. 1 is a view of the full putter.

FIG. 1 illustrates a mallet style golf club having a shaft 10 with a gripping portion 12 attached to one end of the shaft using adhesive or other means known to those skilled in the art and are as such considered to be within the purview of the present invention. At the other end of the shaft is the mallet style golf head 2 through 6 which is attached using adhesive or other means known to those skilled in the art and are as such also considered to be within the purview of the present invention. In the preferred embodiment (putter), a cavity is drilled/carved into the top of the putter head, near the face, between the sweet spot and the heel of the putter head to accommodate the external diameter of a shaft. The cavity in the preferred embodiment (putter) is drilled/carved from the top into the middle of the putter head to create an angle of lie for the shaft that measures 68° to 76° from the heel-toe horizontal plane that is tangential to the top of the putter head.

FIG. 2 through FIG. 6 illustrate a preferred embodiment of a mallet style golf head (putter) 2 though 6 of the present invention which has an object, among others, the design of a 360 degree, three-dimensional single surface alignment system for putting. Prior art contains markings on top of club heads which enable the golfer to align the hand position and club face position using parallax. Other prior art is available with grooves, engraving, and/or applied markings on the face of the putter head which allow the golfer to "line-up" a putt. In these inventions, the integrity of the putter face is in some way violated, which can affect the true point of contact between the ball and the club face. Such violations in integrity can produce laterally deflected rebounding forces causing the ball to deflect off the true line of the putt, thereby negating any benefit of an alignment system on the face of the putter head. The single surface one, two or three dimensional alignment system of the present invention maximizes the potential for proper alignment of the shot yet minimizes the chances for the shot to be deflected because of any irregularities on the face of the putter head.

Figure 2:
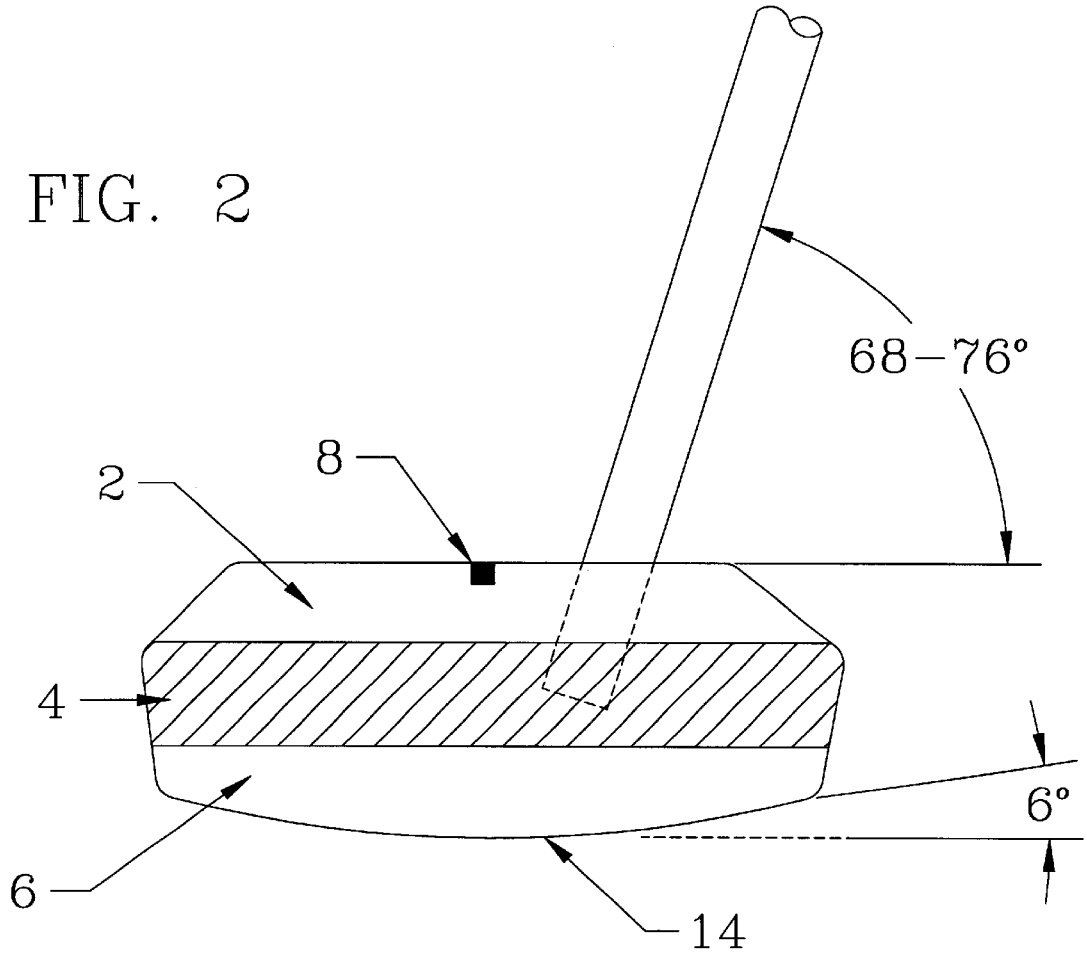
FIG. 2 is a side view of the putter head showing the solid surface horizontal line on the face, shaft insertion and the sole radius.

FIG. 2 shows a preferred embodiment of the formation of the single surface three-dimensional alignment system 2, 4, 6, 8. While not illustrated, any means of assembly of contrasting colored pieces 2, 4, 6 of the same material to create a horizontal line on the face of the putter may be employed within the spirit of the present invention. In the preferred embodiment, the putter head may be manufactured by joining two or more pieces of the same material using epoxy or any bonding material that is compatible with the material used for the putter head. Optional placement of an alignment line 8 on the top of the putter head, over the "sweet spot" by any known means may be considered within the scope of the present invention. In the preferred embodiment, lines and holes are drilled/carved on top of the putter head over the "sweet spot." The cavities are filled with a material that is compatible with the material in the putter head, can be inlaid into the cavities in the putter head, creates a contrasting color with the top of the putter head, and does not distort the overall shape of the putter head. FIG. 2 also shows a preferred embodiment of the putter head with an arcuate curvature of the sole. This arcuate shape allows the golfer to adjust the hand position at address to the ball to a flatter or more upright position without increasing the area of contact between the sole of the putter head and the putting surface. Minimizing this contact area reduces the amount of drag or resistance if the golfer hits a "fat shot" (a fat shot is when the club hits or brushes the ground behind the ball before impact). Also, the arcuate shape provides similar benefits to the golfer when the ball may be putted but lies in taller grass surrounding the green (the "fringe"). In the preferred embodiment, the arcuate shape is formed through cutting, milling, sanding or molding the bottom component of the putter head to the specified number of degrees measured from the bottom center to the heel and to the toe of the putter head.

Figure 3:
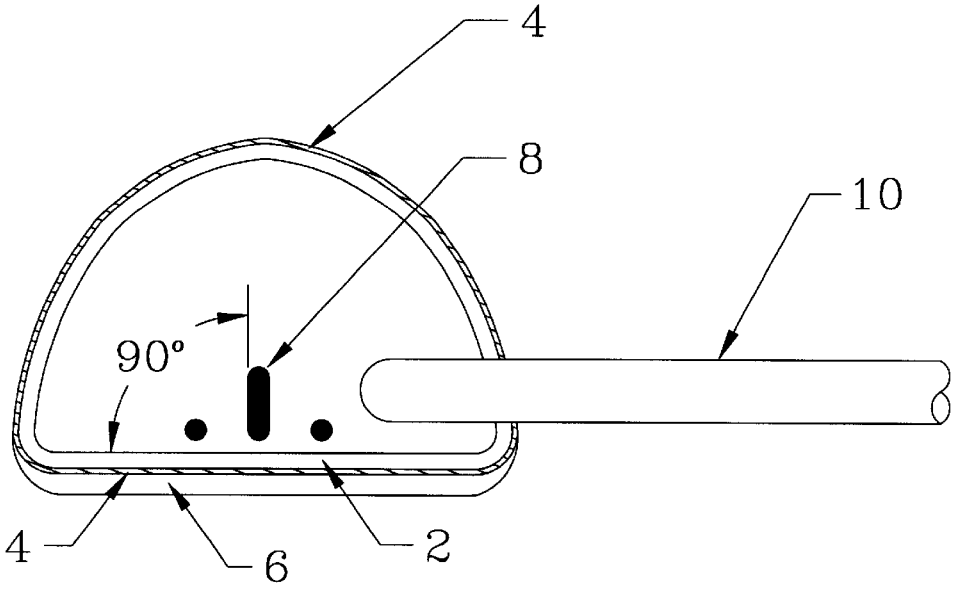
FIG. 3 is a top view of the putter head showing the 360 degree, three-dimensional alignment system.

FIG. 3 demonstrates the principle of the 360 degree, three-dimensional alignment system in the preferred embodiment whereby the top alignment line 8 forms a visually perceived 90° angle with the thin visible horizontal contrasting line 4 on the face when the putter head is positioned correctly at the address of the golf ball. In addition, the thin visible line 4 is visually perceived around the circumference of the putter head when the eyes are positioned correctly at the address of the golf ball. The correct positioning of the putter head is thus provided on three planes: (1) top alignment line 8 perceived at a 90° angle to (2) contrasting line 4 on the face and (3) the perception of a thin contrasting line 4 continuing around the circumference of the putter head, intersecting with thin line 4 on the face forming the 360 degree component of the alignment system. The visibility of the thin horizontal line 4 on the face is due to the loft of the club face. The visibility of the continuation of the thin line 4 around the remainder of the putter head is due to an angle cut around the top circumference of the club. The perceived intersection of the face and circumference thin line 4 gives the 360 degree component of the alignment system. These two concepts illustrating the angles to form line 4 are shown for the preferred embodiment in FIG. 6.

Figure 4:
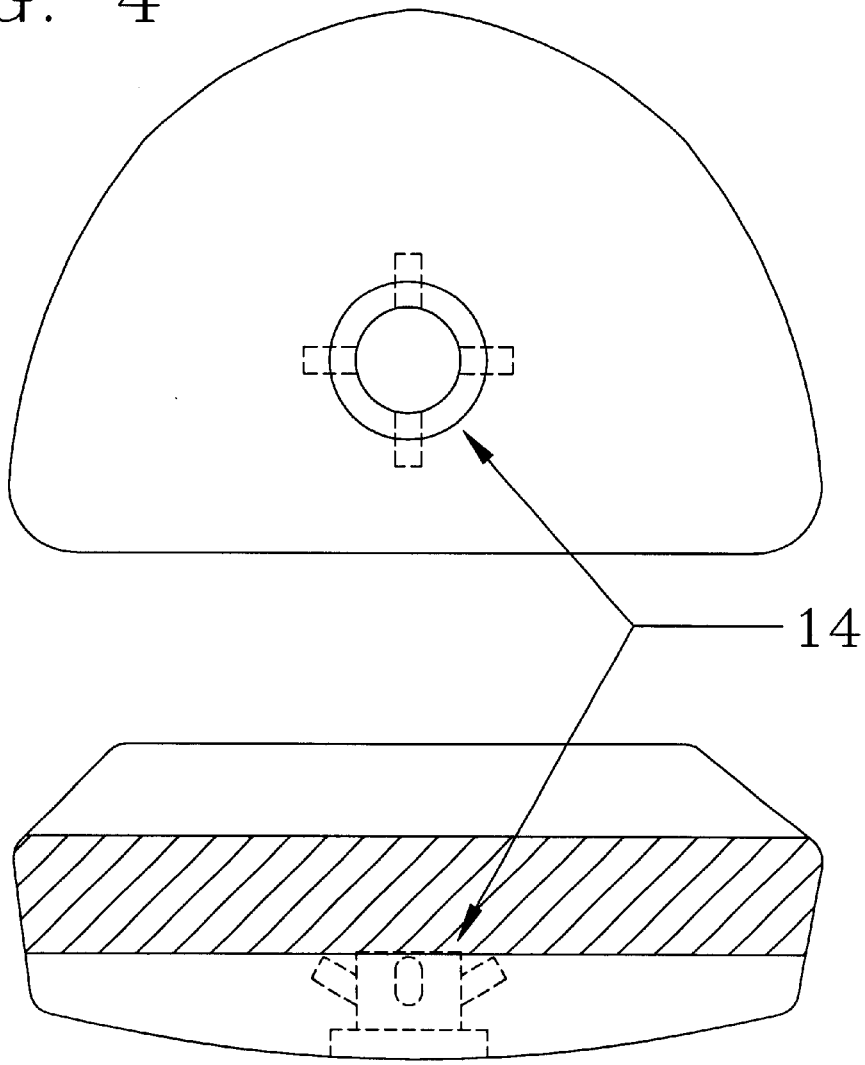
FIG. 4 is a bottom and side view of the present putter head invention showing the design and placement of the cavity for weight insertion.
Figure 5:
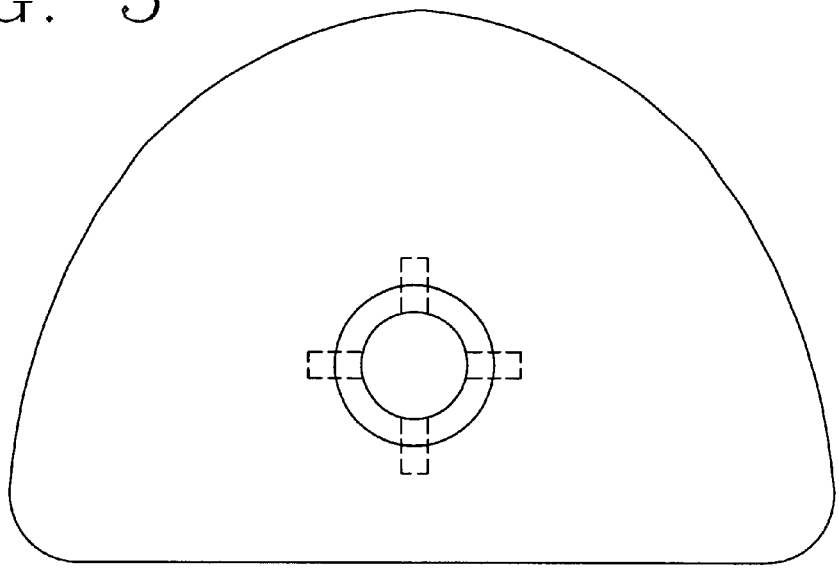
FIG. 5 is a bottom view of the putter head showing an external only view of the cavity for weight insertion.
Figure 6:
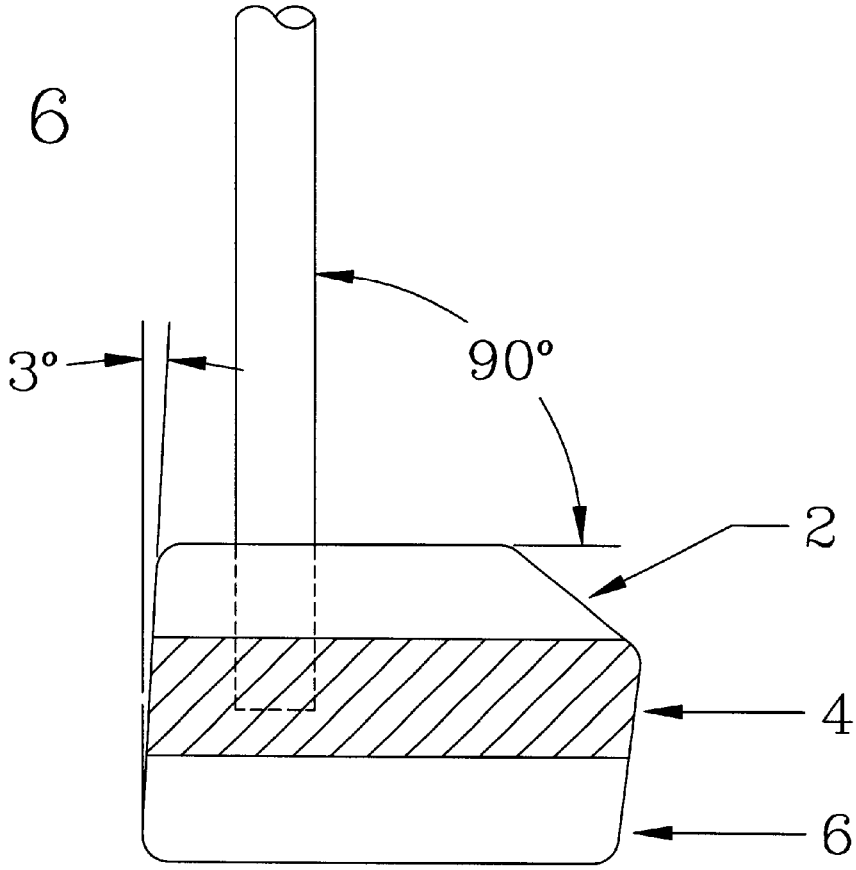
FIG. 6 is a view from the heel of the putter head showing the loft on the putter face required to produce the visually perceived component of the two dimensional alignment system and the angles on the circumference of the putter head showing the design resulting in the 360 degree three-dimensional alignment system.

FIGS. 4 and 5 show the design, placement, and outward appearance of the cavity for weight insertion for the preferred embodiment. Although not illustrated, a cavity for weight insertion, created using any means, is considered within the scope of the present invention. In the preferred embodiment, the cavity is created on the bottom of the putter head by drilling/carving an inner core for insertion of a molten liquid alloy (of greater density than the material used for the putter head) used to add additional mass to the putter head. Proximal to the surface of the bottom of the putter head, a larger diameter/width cavity with a depth that is sufficient to accommodate a cover and seal for the weight cavity is drilled/carved in a position to the original cavity that creates concentricity. Small capillary type cavities are drilled/carved in a radial direction to the original cavity to allow a molten liquid alloy to form an anchor within the subject cavity upon solidification. The purpose of optimizing weight is to keep the putter head at a mass that imparts a good roll to the ball yet is not so heavy as to make the golfer execute too short a back swing or grip the club too tightly. Either or both actions result in incomplete strokes or putts that are too forceful.

Although not illustrated, the preferred embodiment (putter) of the club head is made with a methyl methacrylate monomer and aluminum trihydrate by DuPont CORIAN®. This material imparts a "softer feel" than metal but has sufficient hardness to create a roll to the ball that has minimal skidding at impact. Reducing skid allows the ball to better roll on line toward the target. Prior art includes nonmetal materials, such as graphite, ceramics, and CORIAN; however, these materials have not been manufactured into a design that provides a single surface facial alignment system or a 360 degree, three dimensional alignment system.

The preferred embodiment (putter)of the present invention combines a single material 360 degree, three dimensional alignment system, weight optimization, reduced putter head putting surface contact (reduced potential for drag), and a nonmetal material in the putter head. These attributes produce a putter head and putter that offer the golfer the optimal conditions to aim, align, and execute an on line shot. These attributes also enable the golfer to utilize a longer back stroke on both long and short (less than three feet) putts, which allows for a pendulum-like stroke, enhances putting accuracy, and results in fewer putting strokes per round of golf.

For other mallet style clubs, the present invention describes a combining of similar composition materials (e.g. metal, wood, composites) to form a 360 degree, three dimensional alignment system. This alignment attribute enables the golfer to position hands and eyes (which impact head and body position) over the ball and receive immediate feedback if either is not properly positioned.

This present invention, therefore, relates to a mallet golf head comprising a club-head body having a front face; a top; a bottom or sole; a heel; a toe; and a rear wherein the front face has a ball striking surface with at least one visible horizontal element aligned in the center of the front face to form a single surface alignment aid and wherein the top has a shaft-receiver cavity between the sweet spot and the heel. The invention further relates to a mallet style golf head wherein the club-head body comprises a metallic or nonmetallic material. The present invention further comprises a putter head wherein the club-head body consists essentially of a synthetic polymeric material selected from CORIAN® (methyl mathacrylate monomer and aluminum trihydrate) from DuPont, or a similar synthetic solid acrylic polymer materials such as those available from Formica, Nevamar, or WilsonArt. The invention further relates to a mallet style golf head wherein at least two pieces of a nonmetallic solid material wherein said pieces form a visible horizontal line element in the center of the front face to form the single-surface alignment aid. The invention further comprises a mallet style golf head wherein the club-head body comprises three joined layers of a nonmetallic solid material, wherein the center layer of the three joined layers is the visible horizontal element aligned in the center of the front face to form the single-surface alignment aid. The invention further relates to a mallet style club head wherein the club-head body comprises three joined layers of a nonmetallic solid material, wherein the nonmetallic material is selected from CORIAN® and further wherein said center layer is the visible horizontal element aligned in the center of the front face and said layer is a different color than the first or third layer to form the single-surface alignment aid. The invention further relates to a mallet style golf head wherein the top of the club head body contains an optional inlaid line at a 90° angle to the single surface alignment aid on the front face, and in combination with said single surface alignment aid, forms a two dimensional alignment system. The invention further relates to a mallet golf style golf head wherein there is an inlaid or laminated line joining the laminated or inlaid horizontal line on the front face and continuing around the circumference of the club forming a visually perceived 360 degree, three dimensional alignment aid. The invention further relates to a mallet style golf head comprising a cavity on a nonstriking surface of the putter head wherein said cavity permits addition of a weight which adds additional mass to the club head.

The present invention, therefore, relates to a mallet style golf club comprising a club shaft selected from stainless steel, graphite, aluminum, wood, or titanium and gripping portion selected from leather, cork, rubber, or USGA conforming grip material at one end of said shaft; a mallet head attached to the other end of said shaft via a shaft receiver cavity on the head wherein the head comprises a club-head body having a front-face ball striking surface, a top; a sole; a heel; a toe; and a rear, wherein the front face has at least one visible horizontal element aligned in the center of the front face to form a single surface alignment aid and further wherein the top may optionally contain an inlaid line formed at a 90° angle to the horizontal alignment aid to form, in combination with said horizontal alignment aid, a two dimensional alignment system, and wherein the circumference of the mallet has an inlaid or laminated line that connects with the visible inlaid or laminated horizontal line on the front face thereby creating a visually perceived 360 degree, three dimensional alignment aid. The invention further relates to a mallet style golf club wherein the head comprises a metallic or nonmetallic solid material. The invention further comprises a mallet style golf club wherein the nonmetallic material is selected from CORIAN® (methyl methacrylate monomer and aluminum trihydrate) from DuPont or similar synthetic solid polymer materials from Formica, Nevamar, or WilsonArt. The invention further relates to a mallet style golf club wherein the club-head body comprises at least two attached pieces of a nonmetallic solid material wherein, for the two pieces, the horizontal line formed between the two attached pieces forms the visible horizontal element aligned in the center of the front face to form the single surface alignment aid, and the inlaid or laminated line on the circumference of the mallet joins the inlaid or laminated horizontal line on the front face to form the visually perceived 360 degree, three dimensional alignment aid. The invention further relates to a mallet style golf club wherein the putter head may optionally contain a cavity on a nonstriking surface wherein said cavity permits addition of a weight which adds additional mass to the club head. The invention further relates to a mallet style golf club wherein the club-head sole may be curved to form an arcuate shape from the bottom center of the head to the bottom of the toe and to the bottom of the heel of the putter head and the arcuate shape is less that or equal to 15° from the horizontal plane tangential to the bottom center the head to the bottom of the heel and toe but is greater than zero degrees. The invention further relates to a mallet style golf club wherein the angle of the front-face striking surface of the club-head from the sole to the top of the head (loft) is greater than or equal to two degrees and less than or equal to 65 degrees. The invention further relates to a mallet style golf head wherein the front-face striking surface of the club-head is milled.

The present invention, therefore, relates to a method of Silk Touch™ alignment whereas the method comprises utilizing a mallet golf club comprised of a club shaft selected from stainless steel, graphite, aluminum, wood, or titanium and gripping portion selected from leather, cork, rubber, or USGA conforming grip material at one end of said shaft; a mallet style club head attached to the other end of said shaft via a shaft receiver cavity on the club head wherein the putter head comprises a club-head body having a front-face ball striking surface, a top; a sole; a heel; a toe; and a rear, wherein the front face has at least one visible horizontal element aligned in the center of the front face to form a single surface alignment aid and further wherein the top may optionally contain an inlaid line formed at a 90° angle to the horizontal alignment aid to form, in combination with said horizontal alignment aid, a two dimensional alignment system to increase alignment precision and accuracy, and the inlaid or laminated line on the circumference of the mallet joins the inlaid or laminated horizontal line on the front face to form a visually perceived 360 degree three dimensional alignment aid. The present invention further relates to a method of Silk Touch™ alignment, wherein the mallet style club head comprises a nonmetallic solid material. The present invention further relates to a method of Silk Touch™ alignment, wherein said non-metallic material is selected from CORIAN®. This invention has been described in detail and refers to a preferred embodiment (putter), but it will be understood that various other modifications may be effected by the spirit and scope of this invention,

What is claimed is:

1. A mallet style golf club head comprising a club head body having a front face ball striking surface with a center and with at least one visible horizontal inlaid or laminated element aligned in the center of the front face ball-striking surface to form a single surface alignment aid; a top; a sole; a heel; a toe and a rear, and an inlaid or laminated line joining the laminated or inlaid horizontal element on the front face ball striking surface and continuing around the circumference of the club forming a visually perceived 360 degree, three dimensional alignment aid, and further wherein the top has a shaft receiver cavity positioned between the "sweet spot" which is located in the center of the front face ball striking surface and the heel to receive a shaft.

2. A mallet style golf club head according to claim 1 wherein the clubhead body comprises a metallic or nonmetallic solid material.

3. A mallet style golf club head according to claim 2 wherein the nonmetallic solid material is selected from methyl methacrylate monomer and aluminum trihydrate.

4. A mallet style golf club head according to claim 1 wherein the clubhead body comprises at least two pieces of a nonmetallic solid material wherein the line between said pieces forms the visible horizontal line element aligned in the center of the front face to form the singlesurface alignment aid and an inlaid or laminated line joining the laminated or inlaid horizontal line on the front face and continuing around the circumference of the club forming a visually perceived 360 degree, three dimensional alignment aid.

5. A mallet style golf club head according to claim 1 wherein the clubhead body comprises three joined layers of a nonmetallic solid material wherein the center layer of the three joined layers is the visible horizontal element aligned in the center of the front face to form the singlesurface alignment aid and also the center layer of the three joined layers forms an inlaid or laminated line joining the laminated or inlaid horizontal line on the front face, continuing around the circumference of the club forming a visually perceived 360 degree threedimensional alignment aid.

6. A mallet style golf club head according to claim 5 wherein the nonmetallic solid material is selected from methyl methacrylate monomer and aluminum trihydrate and further wherein said center layer is a different color than the first or third layer.

7. A mallet style golf club head according to claim 1, wherein the top of the clubhead body contains an inlaid line at a 90° angle to the single surface alignment aid on the front face, and in combination with said single surface alignment aid, enhances the 360 degree, three dimensional alignment aid.

8. A mallet style golf club head according to claim 1 further comprising a cavity on a nonstriking surface of the club head wherein said cavity permits addition of a weight which adds additional mass to the club head.

9. A mallet style golf club comprising a club shaft and gripping portion at one end of said shaft; a mallet style golf club head attached to the other end of said shaft via a shaft receiver cavity on the mallet style golf club head wherein the mallet style golf club head comprises a mallet style golf club head body having a front face ball striking surface with a center and with at least one visible horizontal inlaid or laminated element aligned in the center of the front face ball-striking surface to form a single surface alignment aid; a top; a sole; a heel; a toe; and a rear, and further wherein the top may optionally contain an inlaid line formed at a 90° angle to the horizontal alignment element to form, in combination with said horizontal alignment element, a two dimensional alignment system, and an inlaid or laminated line joining the laminated or inlaid horizontal element on the front face ball striking surface and continuing around the circumference of the club forming a visually perceived 360 degree, three dimensional alignment aid.

10. A mallet style golf club according to claim 9, wherein the mallet style club head comprises a metallic or nonmetallic solid material.

11. A mallet style golf club according to claim 10, wherein the nonmetallic material for the mallet style club head is selected from methyl methacrylate monomer and aluminum trihydrate.

12. A mallet style golf club according to claim 9, wherein the mallet style clubhead body comprises at least two attached pieces of a nonmetallic solid material wherein, for the two pieces, the horizontal line formed between the two attached pieces forms the visible horizontal element aligned in the center of the front face to form the single surface alignment aid and also forms an inlaid or laminated line joining the laminated or inlaid horizontal line on the front face and continues around the circumference of the club forming a visually perceived 360 degree, three dimensional alignment aid.

13. A mallet style golf club according to claim 9, wherein the mallet style club head may optionally contain a cavity on a nonstriking surface wherein said cavity permits addition of a weight which adds additional mass to the mallet style club head.

14. A mallet style golf club according to claim 9, wherein the mallet style club head sole may be curved to form an arcuate shape from the bottom center of the mallet style golf club head to the bottom center of the toe and to the bottom center of the heel of the mallet style club head and the arcuate shape is less than or equal to 20° from the horizontal plane tangential to the bottom center of the head to the bottom of the heel and toe but is greater than zero degrees.

15. A mallet style golf club according to claim 9, wherein on the mallet style golf club head, the angle of the frontface ball striking surface from the sole to the top of the mallet style golf club head (loft) is greater than or equal to two degrees and less than or equal to sixty-five degrees.

16. A mallet style golf club according to claim 9, wherein the mallet style golf club head frontface ball striking surface is milled.

* * * * *